US008468828B2

(12) United States Patent
Bausch et al.

(10) Patent No.: US 8,468,828 B2
(45) Date of Patent: Jun. 25, 2013

(54) WORKING FLUID FOR A STEAM CYCLE PROCESS AND METHOD FOR THE OPERATION THEREOF

(75) Inventors: Christian Bausch, Bubesheim (DE); Jens Grieser, Sohnstetten (DE); Jurgen Berger, Gerstetten (DE)

(73) Assignee: Voith Patent GmbH, Heidenheim (DE)

( * ) Notice: Subject to any disclaimer, the term of this patent is extended or adjusted under 35 U.S.C. 154(b) by 704 days.

(21) Appl. No.: 12/451,009

(22) PCT Filed: Jan. 24, 2008

(86) PCT No.: PCT/EP2008/000514
§ 371 (c)(1),
(2), (4) Date: Feb. 2, 2010

(87) PCT Pub. No.: WO2008/131810
PCT Pub. Date: Nov. 6, 2008

(65) Prior Publication Data

US 2010/0139273 A1 Jun. 10, 2010

(30) Foreign Application Priority Data

Apr. 26, 2007 (DE) ..... 10 2007 020 086

(51) Int. Cl.
*F01K 25/06* (2006.01)
*F01K 13/02* (2006.01)

(52) U.S. Cl.
USPC ..... 60/649; 60/651; 60/671; 60/646; 60/657

(58) Field of Classification Search
USPC ..... 60/649, 651, 671, 646, 657
See application file for complete search history.

(56) References Cited

U.S. PATENT DOCUMENTS

| | | | | |
|---|---|---|---|---|
| 3,841,099 | A | 10/1974 | Somekh | |
| 5,005,361 | A * | 4/1991 | Phillips | 60/671 |
| 5,557,936 | A * | 9/1996 | Drnevich | 60/649 |
| 6,116,027 | A * | 9/2000 | Smith et al. | 60/648 |
| 7,347,049 | B2 * | 3/2008 | Rajendran et al. | 60/649 |

FOREIGN PATENT DOCUMENTS

| | | | |
|---|---|---|---|
| DE | 103 28 289 | | 1/2005 |
| DE | 102 28 868 | | 11/2005 |
| EP | 0 122 017 | A2 | 10/1984 |
| EP | 0 328103 | A1 | 8/1989 |
| EP | 1 653 055 | | 5/2006 |
| EP | 1 653 055 | A2 | 5/2006 |
| JP | 2005-538039 | | 12/2005 |
| WO | WO 2005/113702 | | 12/2005 |
| WO | WO 2006/084262 | | 8/2006 |
| WO | WO 2006/137957 | | 12/2006 |
| WO | WO 2007/014942 | A2 | 2/2007 |
| WO | WO 2007/082103 | | 7/2007 |

* cited by examiner

*Primary Examiner* — Hoang Nguyen
(74) *Attorney, Agent, or Firm* — Farjami & Farjami LLP

(57) ABSTRACT

The invention relates to a working fluid for a steam circuit process carried out in a device comprising a steam generator, an expander, a condenser, and a reservoir for the working fluid, comprising a working medium that evaporates by the addition of heat in a steam generator, performs mechanical work by expanding in the expander during the steam phase, and condenses in the condenser; an ionic fluid serving as an antifreeze component and having a melting point in the reservoir below the freezing point of the working medium, wherein the decomposition temperature of the ionic fluid is above the evaporating temperature of the working medium in the steam generator.

18 Claims, 2 Drawing Sheets

WORKING FLUID FOR A STEAM CYCLE PROCESS AND METHOD FOR THE OPERATION THEREOF

This is a U.S. national phase application which is based on, and claims priority from, PCT application Serial No. PCT/EP2008/000514, filed on Jan. 24, 2008, which claims priority from foreign application Serial No. DE 102007020086.4, filed on Apr. 26, 2007 in Germany.

The invention relates to an operating fluid for a steam cycle process and an operating method for performing the steam cycle process.

Steam cycle processes are used for converting thermal energy into mechanical energy and are used for power generation units for example which generate a heat flow by means of a burner device, which heat flow is supplied to a steam generator. In the steam generator, a working medium is evaporated by the supply of heat, with the steam phase thus produced being supplied to an expander for relaxation, performing mechanical work in the same and thereafter condensing in the condenser. The condensate is then typically supplied to a reservoir, from which the renewed flow to the steam generator occurs by means of a feed pump for the working medium.

A steam motor can further be used to utilize the waste heat of an internal combustion engine, such that its exhaust gas flow is supplied to a heat exchanger device in the steam generator. It is alternatively or additionally possible to use the waste heat in the cooling water of an internal combustion engine for operating a steam cycle process. The mechanical power generated in the expander can then be supplied at least indirectly to a shaft of the drive system or there is a drive of an electric generator by the expander. In this way, an apparatus for performing a steam cycle process can be arranged as an auxiliary unit that utilizes the waste heat of a main engine which either motively supports the propulsion of the vehicle or provides electric energy for the auxiliary devices.

The principal demand is placed on the working medium for operating the steam cycle process in order to achieve a high efficiency that there is a large temperature difference between the steam phase and the condensate. This requires that the working medium remains thermally stable up to high temperatures, typically above 400° C. There are further requirements concerning protection from corrosion for the steam generator apparatus and the transport of lubricants in the steam phase, especially for performing self-lubrication of the movable components of the expander. Furthermore, one must take into account a longer standstill of the steam cycle process at simultaneously low temperatures in a configuration of non-continuous operation, especially when used in a vehicle, so that precautions are taken for protection from frost.

Accordingly, the operating fluid for a steam cycle process comprises additives given to the working medium. They can form an azeotrope with the working medium. One example for this is disclosed by DE 103 28 289 B3 which proposes as an operating fluid for a steam cycle process a mixture of water and at least one heterocyclic compound and additional miscible polymers, surface-active and/or other organic lubricants. Especially 2-methyl pyridine, 3-methyl pyridine, pyridine, pyrrole and pyradizine are proposed as a heterocyclic compound. The freezing point of the operating fluid is set to beneath 0° C. as a result of the use of the heterocyclic compound. At the same time, the heterocyclic compound forms a azeotrope with water, so that it transfers to the gas phase together with the share of water in the steam generator. In this case, lubricants are also transported in the steam phase to the expander for performing a self-lubrication.

The disadvantageous aspect in the known operating fluids for steam cycle processes is their toxicity, so that extensive precautions need to be taken in order to securely prevent the leakage of operating fluid and its gas phase. When used in vehicles, especially motor vehicles, this cannot be excluded completely in view of possible accident hazards.

Concerning the state of the art as published in print, reference is hereby made to the documents DE 102 28 868 B4 and U.S. Pat. No. 3,841,099. The first document describes a working fluid for use in a Rankine cycle process in motor vehicles. The latter document describes a steam engine with a closed cycle, with water being used as a working medium.

The invention is therefore based on the object of providing an operating fluid for a steam cycle process which enables a cold start of the steam cycle process at any time, especially for discontinuous operation and longer standstill periods even at low ambient temperatures, and especially ensures protection from frost for the system. At the same time, the operating fluid should be environmentally compatible and especially not be toxic for plants and living beings and be characterized by a high amount of security against accidents. Moreover, it is a further object of the invention to provide a method with which the steam cycle process can be operated with the operating fluid in such a way that it is arranged to be as energy-efficient as possible, and an apparatus for performing the method.

This object of the invention is achieved in such a way that the operating fluid comprises at least two components. The first component provides a working medium which is used for the actual operation of the steam cycle process. Accordingly, evaporation of the working medium occurs by the supply of heat in the steam generator, followed by relaxation by performing mechanical work in the expander and thereafter condensation by returning the condensate, typically via a reservoir and a feed pump, for renewed entrance into the cycle, which means for renewed evaporation in the steam generator.

A further component of the operating fluid in accordance with the invention for the steam cycle process represents an anti-freeze which is substantially not subject to any evaporation in the steam generator under normal operating conditions and is merely used to keep the operating fluid in the liquid state in the reservoir even at low outside temperatures and thus enables cold starting of the system.

An ionic fluid is used in accordance with the invention as an anti-freeze. Ionic fluid shall be understood to be a salt which is fluid under 100° C. It is necessary for the present object that the ionic fluid has a melting point which lies lower than the freezing point of the working medium in order to increase anti-freezing protection of the operating fluid for the steam cycle process. An ionic fluid is preferable one whose melting point lies at −30° C. or lower.

The low melting point of ionic fluids is caused by adverse ion coordination. Delocalized charges are responsible for this, with typically at least one ion being based on an organic molecule and the formation of a stable crystal lattice already at low temperatures being prevented. The selection of suitable cations and anions for forming an ionic fluid comprises alkylated imidazolium, pyridinium, ammonium or phosphonium as cations. Simple halides can be used as anions, with the possible selections reaching from more complex inorganic ions such as tetrafluoroborates up to inorganic ions such as trifluoromethane sulfonimide.

The choice of selection of their physico-chemical properties by the choice of their pairings of cations and anions is typical for ionic fluids, so that it is possible to tailor an ionic fluid for the operating fluid in accordance with the invention for the steam cycle process in such a way that a lower melting point is obtained within the terms of an anti-freeze effect. This is typically achieved by a respective choice of an organic cation. By choosing a suitable inorganic anion, influence can typically be made on the miscibility with further components such as water or other substances, so that it is possible to advantageously adapt the ionic fluid in such a way that it will enter into a mixture with the working medium. It is also possible that the working medium is incorporated in the form of a colloidal mixture in the ionic fluid, with the security from freezing of the operating fluid being ensured in this case too by a respectively low chosen melting point of the ionic fluid.

A special advantage of ionic fluid for use as part of an operating fluid for a steam cycle process can be seen in such a way that the ionic fluid is characterized up to its decomposition temperature by a disappearing steam pressure. When the decomposition temperature is set in such a way by a respective choice of the pairing of cations and anions that it will lie above the temperature of the liquid phase of the operating fluid in the steam generator, it is possible that the ionic fluid will not enter the gas phase like the actual working medium and is guided to the expander. This leads to a simple possibility for separating the ionic fluid from the operating fluid in the case that the operating temperature of the steam cycle process is reached or that there is a temperature in the system in which security from freezing is no longer required.

After the separation of the ionic fluid from the operating fluid, the energetically disadvantageous case can be prevented for the operation at temperature that the anti-freeze component, which means the ionic fluid, needs to be heated in the steam generator without making an energetic contribution in the steam cycle.

According to an advantageous embodiment, the operating method comprises the following work steps:

The starting point is the standstill of the steam cycle process in cold outside temperatures. The operating fluid is collected in a reservoir and contains a mixture with the working medium which is provided for evaporation in the steam generator and the ionic fluid as the anti-freeze. In accordance with the invention, the melting point of the ionic fluid is beneath the freezing point of the working medium and especially at −30° C. or lower. The working medium enters into a mixture with the ionic fluid or is incorporated in the same in the form of colloids, so that even at low outside temperatures the operating fluid is present in a liquid form in the reservoir during the standstill of the steam cycle process.

When starting the steam cycle process, thermal energy is supplied to the steam generator via an exhaust gas flow from an internal combustion engine for example. At the same time, operating fluid enters the steam generator which can occur by means of a feed pump for example. An evaporation of the working medium occurs in the steam generator, whereas the ionic fluid does not produce any steam pressure and is returned to the reservoir. According to an alternative embodiment, the return does not occur to a reservoir, but to a tank for the ionic fluid.

The vaporous working medium is supplied to the condenser after its relaxation and performance of work in the expander, with the condensate of the working medium thus obtained not being returned to the reservoir again according to an advantageous embodiment, but being supplied to a separate tank for the working medium. As a result of this measure, a progressing separation of the ionic fluid and the working medium is obtained. Notice must be taken that this separation should advantageously only be made above a specific operating temperature. That is why the operating temperature can be measured at different locations in the apparatus for performing the steam cycle process, with the operating fluid in the reservoir being used advantageously as the place for measuring the temperature. When a specific temperature is reached in the reservoir which is above the freezing point of the working medium, the separation of the working medium and the ionic fluid as described above can be performed. Different separation methods can be used in this case.

A changeover can be made after a specific period of time and/or upon reaching a specific filling level in the tank for the working medium and the reservoir can be separated from the steam generator and an exclusive supply of fluid from the tank for the working medium can be performed. This changeover characterizes the operation of the steam cycle process with respect to temperature, in which the working medium without the ionic fluid comes into contact with the heat flow in the steam generator and passes through the steam cycle process.

When the steam cycle process is stopped again, the separated ionic fluid can be joined with the further components of the operating fluid at a respectively low ambient temperature. The mixing advantageously only occurs beneath a bottom limit temperature in the reservoir for the operating fluid. According to a simplified embodiment, the renewed mixing can also occur after a predetermined interval after switching off the steam cycle process or one of its partial components, e.g. the feed pump for the volume flow to the steam-generator.

In addition to the above possibility to use the ionic fluid as an anti-freeze which can be taken from the steam cycle during operation at temperature, ionic fluids as a share of the operating fluid are also characterized by further advantageous properties. Ionic fluids are typically not combustible, they are electrically conductive and thus suppress the build-up of flow potentials. Ionic fluids further act in an anticorrosive way. Moreover, their viscosity and density and their mixing behavior with other fluids can be set in a wide range by choosing the anion/cation pairing.

According to an advantageous embodiment, the operating fluid comprises further components, especially lubricants, which are preferably chosen in such a way that they enter into an azeotrope with the working medium provided for evaporation and therefore co-converge into the steam phase and are suitable for performing self-lubrication, especially the movable components of the expander.

Moreover, such ionic fluids are added to the operating fluid for a steam cycle process which are characterized by their environmental compatibility, their non-toxicity and safety from causing accidents. 1-ethyl-3-methylimidazolium or 1-butyl-3-methylimidazolium (BMIM) or tris-(2-hydroxyethyl)-methylammonium (MTEOA) is used as cations for a preferred example of ionic fluids and the anions are chosen from the group which is formed by $Cl^-$, $HSO_4^-$, $CH_3SO_3^-$, $AlCl_4^-$, $SNC^-$, $CH_3CO_2^-$, $MeOSO_3$ and $EtOSO_3^-$.

The invention is explained below in closer detail by reference to the drawings. They show the following in detail:

Figure 1:
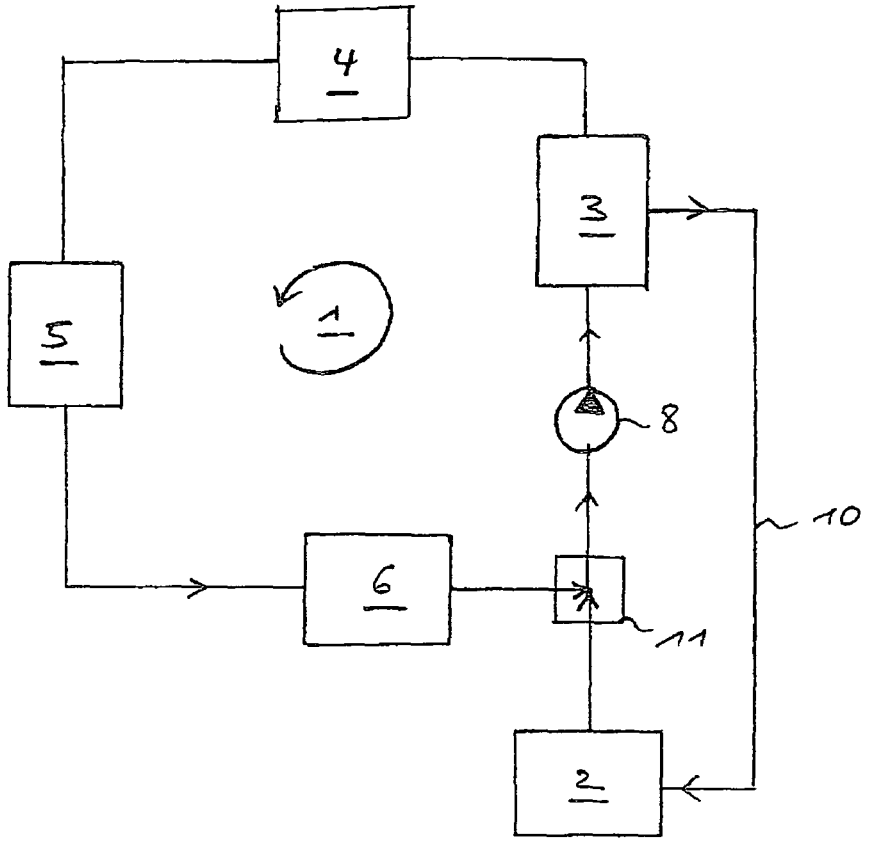
FIG. 1 shows a principal diagram of an apparatus for performing a steam cycle process which is used for implementing the operating method in accordance with the invention.

FIG. 1 shows a schematic simplified view of the basic components for an apparatus for performing a steam cycle process 1. The steam cycle process can be arranged as a Clausius/Rankine process or as a cycle process of type Kalina as possible embodiments. In the latter case, the working medium consists of several components which converge into the steam phase at different temperature levels.

A reservoir for the operating fluid 2 stores the operating fluid as a fluid phase. It is typically guided from there by means of a feed pump 8 to the steam generator 3, which pump is advantageously arranged for adjusting the volume flow in a speed-variable manner. The steam phase generated there enters the expander 4 and performs mechanical work during relaxation. Subsequently, there is condensation in the condenser 5 and the return of the condensate.

In accordance with the invention, the operating fluid comprises an ionic fluid as an anti-freeze at least under cold starting conditions, in addition to the working medium required for the evaporation in the steam generator 3. Accordingly, the melting point of the ionic fluid is chosen lower than the freezing point of the working medium, with the melting point being provided at −30° C. or lower.

The ionic fluid does substantially not generate any partial pressure during the operation of the steam generator 3. Accordingly, the pairing of cations/anions of the ionic fluid is chosen in such a way that the decomposition temperature lies above the operating temperatures in the steam generator 3. It is possible in this respect that the steam generator 3 is arranged in such a way that the temperature in the fluid phase of the operating fluid in the steam generator 3 is set beneath the decomposition temperature of the ionic fluid at least during a specific operating phase. It is therefore possible to permit temperatures above the decomposition temperature in parts of the steam generator 3 in which only the working medium is present as a steam phase or to provide an operating phase which after the removal of the ionic fluid from the operating fluid permits a temperature at least for parts of the steam generator 3 which lies above the decomposition temperature of the ionic fluid. It is ensured by the measure as described above that the ionic fluid in the steam generator 3 remains stable and will not converge into the steam phase and can thus be guided out of the steam generator 3 in a fluid state.

According to a first embodiment which is outlined in FIG. 1, the ionic fluid is returned by means of a bypass line 10 to the reservoir for the operating fluid 2 after passing through the steam generator 3. A tank for the working medium 6 is provided in addition in which the condensate collects from the condenser 5. The condensate should substantially not contain any ionic fluid. It is consequently possible, once a certain operating temperature has been reached such as a certain threshold temperature in the reservoir for the operating fluid 2, that the ionic fluid is removed at least partly from the operating fluid, so that no unused heat dissipation occurs from the steam generator. It is preferable to remove at least 50% of the ionic fluid originally present in the operating fluid from the steam cycle process. Preferably, a higher percentage is removed, especially 80% and more, especially preferably at least 95%.

Figure 2:
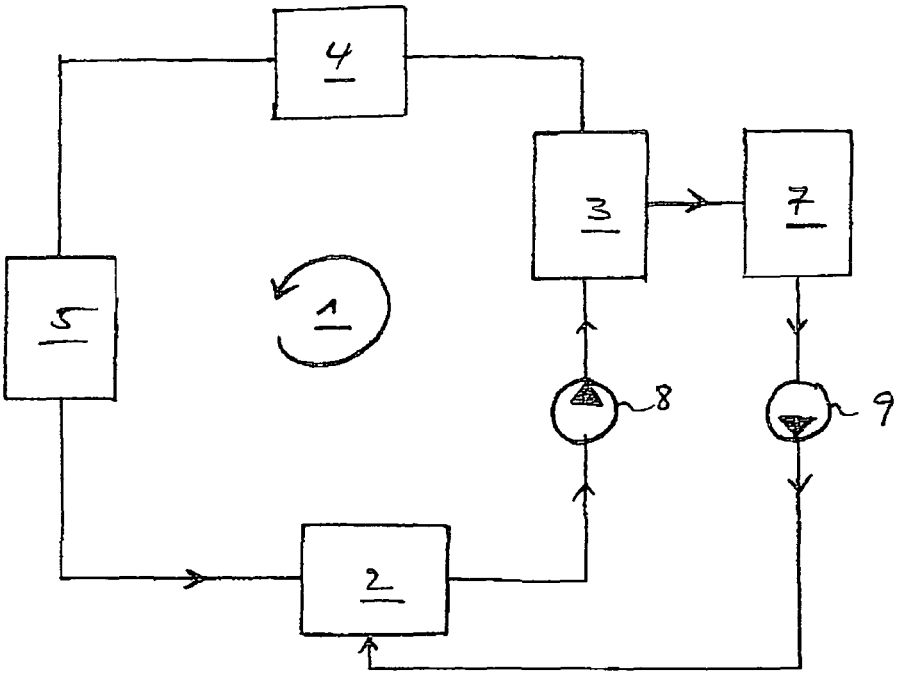
FIG. 2 shows an alternative embodiment of the apparatus of FIG. 1.

According to the diagram shown in FIG. 1, the removal of the ionic fluid from the operating fluid occurs by evaporation of the working medium in steam generator 3 and its collection in the tank for the working medium 6. Preferably, a valve unit 11 which controls the inflow from the tank for the working medium 6 or the reservoir for the operating fluid 2 to the steam generator is switched in such a way upon reaching a specific filling level in the tank for the working medium 6 which corresponds to the volume of working medium necessary for the operation of the steam cycle process 1 that the reservoir for the operating fluid is decoupled and the feed pump 8 only obtains fluid from the tank for the working medium 6. This changeover by means of the valve unit 11 can occur either in a time-controlled and/or filling-level-controlled and/or temperature-controlled manner and/or controlled depending on the concentration of the ionic fluid in the operating fluid. FIG. 2 shows a further possible embodiment of an apparatus for performing a steam cycle process with the operating fluid in accordance with the invention with a possibility for separating the ionic fluid from the operating fluid for a system at temperature. In contrast to the embodiment according to FIG. 1, a separate tank for the ionic fluid is outlined in FIG. 2 which is connected with a discharge for the fluid phase on the steam generator 3. Accordingly, the non-evaporated parts of the operating fluid will collect in the tank for the ionic fluid, so that there is an enrichment of the ionic fluid here. Beneath the operating temperature and especially at temperatures where there is a likelihood of freezing, there is a return of the ionic fluid from the tank for the ionic fluid 7 to the reservoir for the operating fluid 2. This can occur for example via the line connection shown in FIG. 2 and a recirculating pump 9 which is provided therein. Once the operating temperature has been reached, this conveying flow can be reduced or returned to zero, so that there is an enrichment of the ionic fluid in the tank for the ionic fluid 7 during further operation of the steam generator 3 and the percentage of the ionic fluid in the reservoir for the operating fluid 2 is reduced, such that condensate of the working medium is supplied continually from the condenser 5. After a certain period of time, a main share and preferably substantially the entire share of the ionic fluid have been removed from the steam cycle process. Once this has been achieved, it is possible according to one embodiment to close the connection between the steam generator 3 and the tank for the ionic fluid 7 and to set a suitably high temperature for the waste steam at the steam generator according to a possible embodiment.

The requirements placed on the ionic fluid concerning a melting point which is sufficiently low for an anti-freeze and a sufficiently high decomposition temperature in order to avoid an evaporation of the working medium from the operating fluid and a decomposition of the ionic fluid in the steam generator 3 are fulfilled by a suitable choice of the cations and anions of the ionic fluid. Furthermore, the pairing of cations/anions is chosen in such a way that an environmentally friendly, non-toxic and operationally reliable ionic fluid is chosen. As already explained above, 1-ethyl-3-methylimidazolium (EMIM) or 1-butyl-3-methylimidazolium (BMIM) or tris-(2-hydroxyethyl)-methylammonium (MTEOA) is used as a possible choice for the cation and is linked to an anion from the group of $Cl^-$, $HSO_4^-$, $CH_3SO_3^-$, $AlCl_4^-$, $SNC^-$, $CH_3CO_2^-$, $MeOSO_3$ and $EtOSO_3^-$.

Additional components are anti-corrosive substances and lubricants, with the same entering into an azeotropic compound with the remaining part of the working medium and form parts of the steam phase which are supplied to the expander. Self-lubrication can be achieved with these measures.

Further embodiments of the invention are possible within the scope of expert knowledge known to the person skilled in the art. It is possible to use a combination of different working media for performing a Kalina process and to provide heat sources at different temperature levels for forming different steam phases. It is accordingly possible to provide the expander with several stages. It is further advantageous to arrange the expander in such a way that in the case of an occurring fault in which a fluid component such as a percentage of the ionic fluid reaches the expander there is sufficient resistance to water hammer. A screw expander is a possible embodiment that meets this requirement. Further expander arrangements are possible, especially in cases where a possible water hammer can be excluded. Reciprocating-piston or rotary-piston machines are preferable in this case.

LIST OF REFERENCE NUMERALS

1 Steam cycle process
2 Reservoir for operating fluid

3 Steam generator
4 Expander
5 Condenser
6 Tank for working medium
7 Tank for ionic fluid
8 Feed pump
9 Recirculating pump
10 Bypass line
11 Valve device

The invention claimed is:

1. A method for operating a steam cycle process which is performed in an apparatus comprising a steam generator, an expander, a condenser and a reservoir for the operating fluid, with the method comprising the following method steps:

during the cold start of the steam cycle process, an operating fluid is supplied to the steam generator which comprises a working medium and an ionic fluid, with the ionic fluid being used as an anti-freeze and has a melting point beneath the freezing point of the working medium in the reservoir, with the decomposition temperature of the ionic medium lying above the evaporation temperature of the working medium in the steam generator;

in the steam generator, the working medium is evaporated and is supplied in vapor form for relaxation to the expander by performing mechanical work and is subsequently condensed in the condenser;

a separation of the ionic fluid and the working medium occurs upon reaching a predetermined operating temperature, so that the percentage by weight of ionic fluid in the operating fluid which is supplied to the steam generator decreases by at least 50%.

2. The method according to claim 1, wherein the condensate of the working medium generated in the condenser is guided from a specific operating temperature into a tank for the working medium which is separate from the reservoir for the operating fluid.

3. The method according to claim 2, wherein the flow of the operating fluid from the reservoir to the steam generator is interrupted from a specific filling level in the separate tank for the working medium and only working medium from the separate tank for the working medium is supplied to the steam generator.

4. The method according to claim 1, wherein the operating fluid that has not been evaporated in the steam generator is supplied to a tank for the ionic fluid which is arranged to be separate from the reservoir for the operating fluid.

5. The method according to claim 1, wherein the operating temperature is determined by a measurement of the temperature of the operating fluid in the reservoir.

6. The method according to claim 1, wherein the ionic fluid and the working medium are joined upon stopping the steam cycle process after a predetermined period of time and/or beneath a specific ambient temperature.

7. A method for operating a steam cycle process which is performed in an apparatus comprising a steam generator, an expander, a condenser and a reservoir for the operating fluid, with the method comprising the following method steps:

during the cold start of the steam cycle process, an operating fluid is supplied to the steam generator which comprises a working medium and an ionic fluid, with the ionic fluid being used as an anti-freeze and has a melting point beneath the freezing point of the working medium in the reservoir, with the decomposition temperature of the ionic medium lying above the evaporation temperature of the working medium in the steam generator;

in the steam generator, the working medium is evaporated and is supplied in vapor form for relaxation to the expander by performing mechanical work and is subsequently condensed in the condenser;

a separation of the ionic fluid and the working medium occurs upon reaching a predetermined operating temperature, so that the percentage by weight of ionic fluid in the operating fluid which is supplied to the steam generator decreases by at least 80%.

8. The method according to claim 7, wherein the condensate of the working medium generated in the condenser is guided from a specific operating temperature into a tank for the working medium which is separate from the reservoir for the operating fluid.

9. The method according to claim 8, wherein the flow of the operating fluid from the reservoir to the steam generator is interrupted from a specific filling level in the separate tank for the working medium and only working medium from the separate tank for the working medium is supplied to the steam generator.

10. The method according to claim 7, wherein the operating fluid that has not been evaporated in the steam generator is supplied to a tank for the ionic fluid which is arranged to be separate from the reservoir for the operating fluid.

11. The method according to claim 7, wherein the operating temperature is determined by a measurement of the temperature of the operating fluid in the reservoir.

12. The method according to claim 7, wherein the ionic fluid and the working medium are joined upon stopping the steam cycle process after a predetermined period of time and/or beneath a specific ambient temperature.

13. A method for operating a steam cycle process which is performed in an apparatus comprising a steam generator, an expander, a condenser and a reservoir for the operating fluid, with the method comprising the following method steps:

during the cold start of the steam cycle process, an operating fluid is supplied to the steam generator which comprises a working medium and an ionic fluid, with the ionic fluid being used as an anti-freeze and has a melting point beneath the freezing point of the working medium in the reservoir, with the decomposition temperature of the ionic medium lying above the evaporation temperature of the working medium in the steam generator;

in the steam generator, the working medium is evaporated and is supplied in vapor form for relaxation to the expander by performing mechanical work and is subsequently condensed in the condenser;

a separation of the ionic fluid and the working medium occurs upon reaching a predetermined operating temperature, so that the percentage by weight of ionic fluid in the operating fluid which is supplied to the steam generator decreases by at least 95%.

14. The method according to claim 13, wherein the condensate of the working medium generated in the condenser is guided from a specific operating temperature into a tank for the working medium which is separate from the reservoir for the operating fluid.

15. The method according to claim 14, wherein the flow of the operating fluid from the reservoir to the steam generator is interrupted from a specific filling level in the separate tank for the working medium and only working medium from the separate tank for the working medium is supplied to the steam generator.

16. The method according to claim 13, wherein the operating fluid that has not been evaporated in the steam generator is supplied to a tank for the ionic fluid which is arranged to be separate from the reservoir for the operating fluid.

17. The method according to claim 13, wherein the operating temperature is determined by a measurement of the temperature of the operating fluid in the reservoir.

18. The method according to claim 13, wherein the ionic fluid and the working medium are joined upon stopping the steam cycle process after a predetermined period of time and/or beneath a specific ambient temperature.

* * * * *